US006045988A

United States Patent [19]

Helling et al.

[11] Patent Number: 6,045,988

[45] Date of Patent: Apr. 4, 2000

[54] COLOR PHOTOGRAPHIC RECORDING MATERIAL

[75] Inventors: Günter Helling, Odenthal; Markus Geiger, Langenfeld, both of Germany

[73] Assignee: Agfa-Gevaert NV, Belgium

[21] Appl. No.: 09/095,827

[22] Filed: Jun. 11, 1998

[30] Foreign Application Priority Data

Jul. 16, 1997 [DE] Germany ..... 197 30 468

[51] Int. Cl.[7] ..... G03C 1/08; G03C 7/26; G03C 7/32

[52] U.S. Cl. ..... 430/551; 430/558

[58] Field of Search ..... 430/551, 558

[56] References Cited

U.S. PATENT DOCUMENTS 4,366,236 12/1982 Takahashi ..... 430/505

FOREIGN PATENT DOCUMENTS 178 789 9/1985 European Pat. Off. .
560 198 3/1993 European Pat. Off. .

*Primary Examiner*—Geraldine Letscher
*Attorney, Agent, or Firm*—Connolly Bove Lodge & Hutz LLP

[57] ABSTRACT

A color photographic recording material which contains on a support at least one blue-sensitive silver halide emulsion layer, which is associated with a yellow coupler, at least one green-sensitive silver halide emulsion layer, which is associated with a magenta coupler, and at least one red-sensitive silver halide emulsion layer, which is associated with a cyan coupler, together with non-photosensitive interlayers between the layers of differing color sensitivity, characterised in that at least one green-sensitive silver halide layer contains a 2-equivalent pyrazolone and/or a pyrazolotriazole coupler as the magenta coupler and at least one interlayer adjacent to this layer contains as a DOP scavenger a polyester comprising at least one dicarboxylic acid of the formula I (I)

in which $L_1$, $L_2$ are optionally substituted, divalent organic residues and $R_1$, $R_2$ are hydrogen, alkyl, aralkyl, alkoxy, aryloxy or halogen and at least one polyhydroxy compound, is distinguished by improved stability under the action of light.

12 Claims, No Drawings

COLOR PHOTOGRAPHIC RECORDING MATERIAL

This invention relates to a colour photographic recording material which contains in a photosensitive silver halide emulsion layer a 2-equivalent pyrazolone and/or a pyrazolotriazole coupler and, in a non-photosensitive layer adjacent thereto, a polyester developer oxidation product (DOP) scavenger.

It is known to produce coloured photographic images by chromogenic development, i.e. by developing silver halide emulsion layers exposed with an image by means of suitable chromogenic developer substances, so-called colour developers, in the presence of suitable colour couplers, wherein the oxidation product of the developer substance, which oxidation product is produced congruently with the silver image, reacts with the colour coupler to form a dye image. Aromatic compounds containing primary amino groups, in particular those of p-phenylenediamine type, are normally used as colour developers.

Pyrazolone couplers are conventionally used to produce magenta dye images. The absorption characteristics of the image dyes obtained from these pyrazolone couplers are in many ways not ideal. Particularly disruptive is the yellow secondary density which makes it necessary to use masking couplers or other masking techniques in order to obtain bright colours in the photographic image. It has proved possible to achieve a certain improvement in this respect by using 3-anilinopyrazolone couplers. However, colour reproduction still leaves something to be desired.

Pyrazoles fused with 5-membered heterocyclics, known as pyrazoloazoles, may also be used as magenta couplers. The advantage thereof over simple pyrazoles is that they yield colour having greater formalin resistance and purer absorption spectra (EP-A- 178 789).

A major problem associated with using the frequently used pyrazoloazole magenta couplers is the low stability of the image dyes obtained therefrom under the action of light.

Investigations have now confirmed that this effect is partially brought about by the DOP scavengers conventionally used in the non-photosensitive interlayers of a colour photographic material. These compounds are preferably either hydroquinone compounds which are substituted by two long-chain or bulky alkyl groups or by a hydrophobing acylamino residue or alternatively disulphonamidophenols (EP-A-560 198).

The object underlying the invention is to improve the stability of a colour photographic recording material which contains a 2-equivalent pyrazolone and/or a pyrazolotriazole magenta coupler.

It has now been found that the above-stated object is achieved with a colour photographic recording material according to claim 1.

The present invention accordingly provides a colour photographic recording material which contains on a support at least one blue-sensitive silver halide emulsion layer, which is associated with a yellow coupler, at least one green-sensitive silver halide emulsion layer, which is associated with a magenta coupler, and at least one red-sensitive silver halide emulsion layer, which is associated with a cyan coupler, together with non-photosensitive interlayers between the layers of differing colour sensitivity, characterised in that at least one green-sensitive silver halide layer contains a 2-equivalent pyrazolone and/or a pyrazolotriazole coupler as the magenta coupler and at least one interlayer adjacent to this layer contains as a DOP scavenger a polyester comprising at least one dicarboxylic acid of the formula I (I)

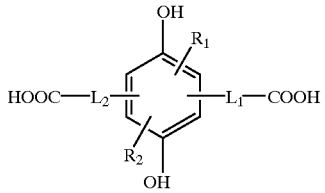

in which $L_1$, $L_2$ are optionally substituted, divalent organic residues and $R_1$, $R_2$ are hydrogen, alkyl, aralkyl, alkoxy, aryloxy or halogen and at least one polyhydroxy compound.

Examples of divalent organic residues are linear or branched alkylene residues and aralkylene residues.

An alkyl residue represented by $R_1$ or $R_2$ or contained therein may be linear, branched or cyclic.

A residue represented by $R_1$ or $R_2$ or contained therein may itself be substituted; possible substituents are halogen, hydroxy, alkyl, alkenyl, alkynyl, aryl, acyl, alkoxy, aryloxy, acyloxy, alkylthio, arylthio or acylamino.

In a preferred embodiment of the invention in the formula I $L_1$, $L_2$ are linear or branched alkylene residues having 1 to 8 carbon atoms and $R_1$, $R_2$ are hydrogen.

In the polyesters according to the invention, 0 to 80 mol. %, preferably 0 to 20 mol. % of the dicarboxylic acids of the formula I may be replaced by other dicarboxylic acids.

These dicarboxylic acids include oxalic acid, malonic acid, succinic acid, glutaric acid, adipic acid, pimelic acid, suberic acid, azelaic acid, sebacic acid, n-undecanoic acid, n-dodecanoic acid, n-tridecanoic acid, n-tetradecanoic acid, n-pentadecanoic acid, n-hexadecanoic acid, maleic acid, fumaric acid, itaconic acid, phthalic acid, isophthalic acid and terephthalic acid.

The polyesters according to the invention may also be produced using, instead of the dicarboxylic acids, the corresponding acid anhydrides, acid halides or lower esters, for example, dimethyl ester.

Examples of compounds of the formula I are:

I-1

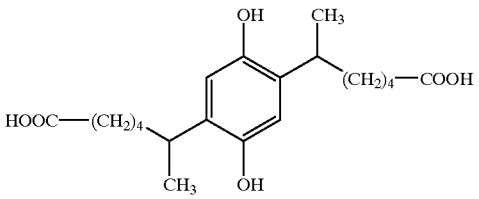

-continued

I-2

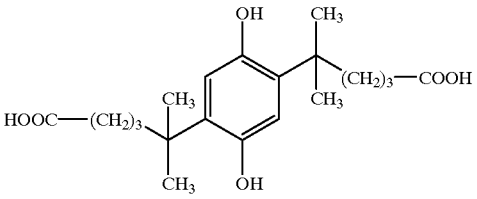

I-3

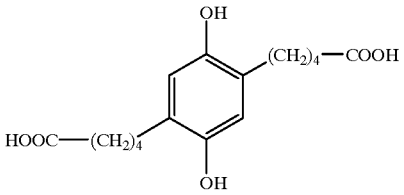

I-4

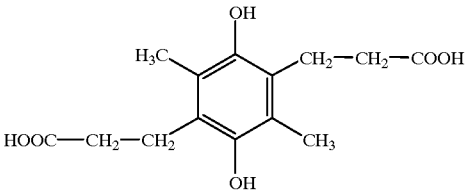

I-5

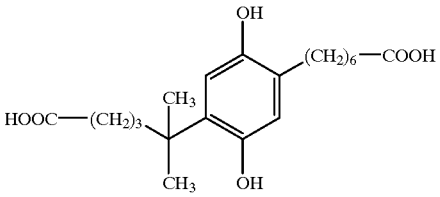

-continued

Compound 1-2 is particularly preferred.

Suitable polyhydroxy compounds are in particular polyalcohols. These include 1,2-ethanediol, 1,2-propanediol, 1,3-propanediol, 1,3-butanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, diethylene glycol, triethylene glycol, neopentyl glycol and glycerol. Further suitable compounds include polyalkylene glycols such as polyethylene glycol and polypropylene glycol, polytetrahydrofuran, polyester diols and polycarbonate diols.

Preferred compounds are aliphatic polyalcohols having 2 to 12 carbon atoms and 2 to 4 OH groups, in particular those having 2 OH groups.

The polyesters according to the invention are produced by reacting one or more dicarboxylic acids of the formula I and optionally further dicarboxylic acids with one or more polyhydroxy compounds at temperatures of 20 to 200° C., preferably of 100 to 200° C., in a molar ratio of 2:1 to 1:2. The reaction may optionally be performed in an inert solvent. Synthetic methods of this type are described in *Ullmann's Encyclopedia of Industrial Chemistry*, VCH Publishers Inc., 1992, volume A 21, pp. 227 et seq.

Examples of polyesters according to the invention are listed in Table I

TABLE 1

| Polyester | Dicarboxylic acid | Polyhydroxy compound | Molar ratio of dicarboxylic acid/polyhydroxy compound | Average molecular weight |
|---|---|---|---|---|
| P1 | I-2 | butanediol | 1.1 | 2500 |
| P2 | I-2 | hexanediol/neopentyl glycol (1:1) | 1.1 | 1900 |
| P3 | I-2 | ethanediol | 1.0 | 3200 |
| P4 | I-3 | butanediol | 1.1 | 2200 |
| P5 | I-4 | butanediol | 1.1 | 2400 |
| P6 | I-2 | butanediol/hexanediol (1:1) | 1.0 | 3800 |
| P7 | I-2 | hexanediol/polytetrahydrofuran (9:1) | 1.0 | 3700 |
| P8 | I-2/adipic acid (1:1) | butanediol | 1.1 | 2700 |
| P9 | I-2/succinic acid (1:1) | butanediol/hexanediol (1:1) | 1.1 | 2300 |
| P10 | I-2 | octanediol/ethanediol (2:1) | 1.0 | 2900 |
| P11 | I-2 | butanediol/polytetrahydrofuran (8:2) | 1.0 | 3600 |
| P12 | I-2 | hexanediol/polytetrahydrofuran (9:1) | 1.0 | 3900 |
| P13 | I-2 | hexanediol | 1.0 | 4200 |

Production of the polyesters according to the invention is illustrated with compound P1 by way of example.

Production of P1

19.7 g (0.05 mol) of dicarboxylic acid I-2 and 5.9 g (0.065 mol) of butanediol were combined with 0.38 g (0.0022 mol) of toluenesulphonic acid and heated to 180° C. under nitrogen for 5 hours. The water arising during the production was removed under a water-jet vacuum. The polyester formed was then purified by precipitation with acetone/water.

Yield: 22 g

The polyesters according to the invention are conventionally used in the colour photographic material in a quantity of 5 to 150 mg/m$^2$ per interlayer. Preferably, 10 to 80 mg/m$^2$ are used.

In a preferred embodiment of the invention, the colour photographic recording material contains a pyrazolotriazole magenta coupler.

Preferred pyrazolotriazole couplers are those of the formula II (II)

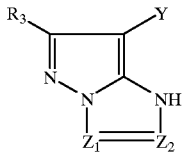

in which $R_3$ is hydrogen, halogen, alkyl, aryl, a heterocyclic group, cyano, alkoxy, acyloxy, carbamoyloxy, acylamino or a polymer residue, Y is hydrogen or a group eliminable under chromogenic development conditions, one of the residues $Z_1$ and $Z_2$ is a nitrogen atom and the other —$CR_4$— and $R_4$ has the same meaning as $R_3$, wherein one of the residues $R_3$ and $R_4$ is a ballast group or is substituted by a ballast group, wherein the ballast group may also be a polymer residue.

In a preferred embodiment,

Y is hydrogen, chlorine, S-alkyl, S-aryl or

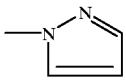

In a further preferred embodiment, $R_3$ and $R_4$ together have at least 15 C atoms.

Examples of suitable pyrazolotriazole couplers of the formula II are stated below.

M-1

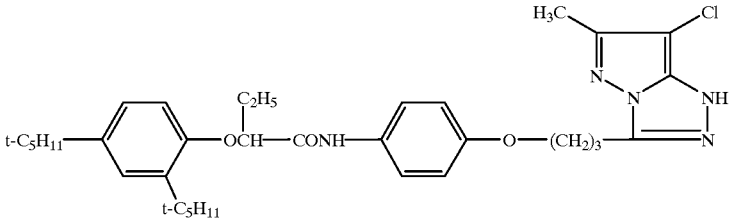

M-2

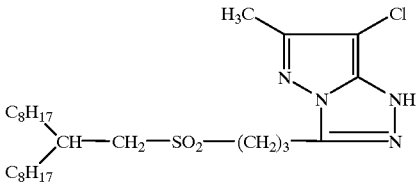

M-3

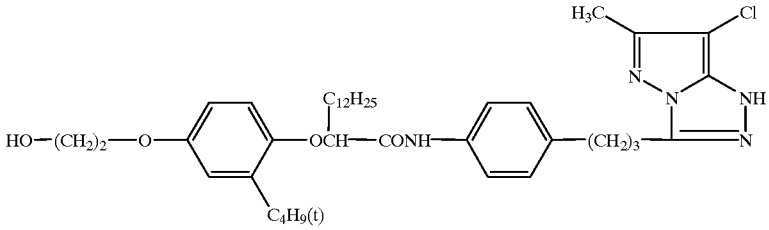

M-4

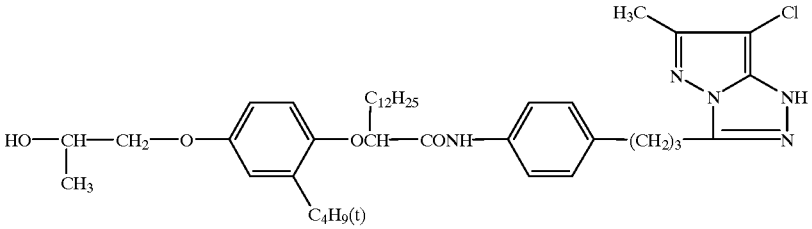

-continued
M-5
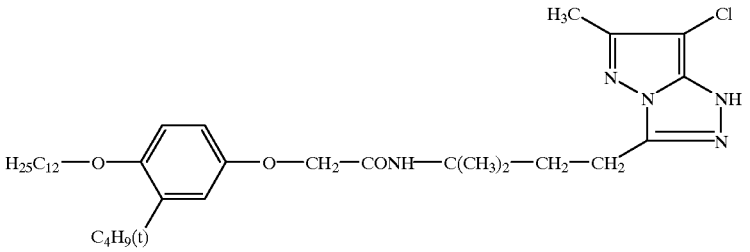
M-6
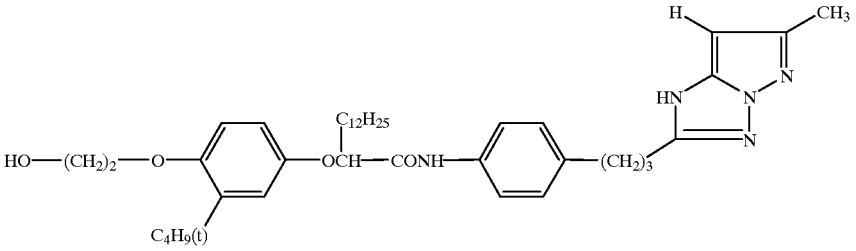
M-7
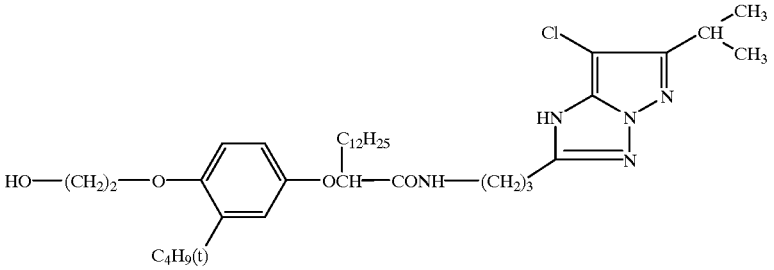
M-8
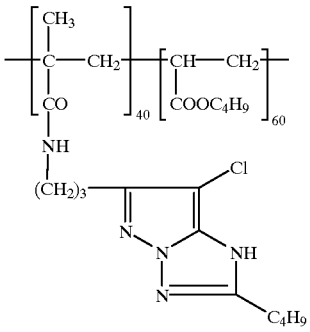
M-9
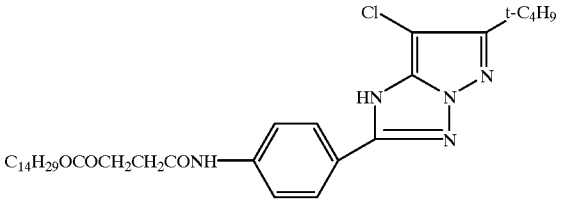
M-10
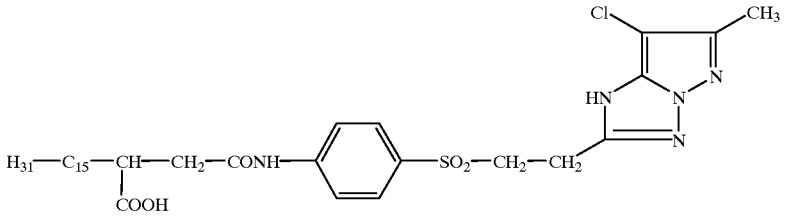

-continued
M-11
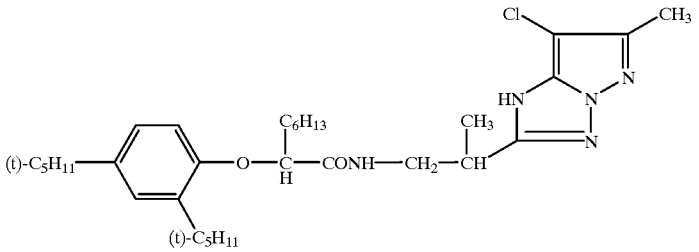
M-12
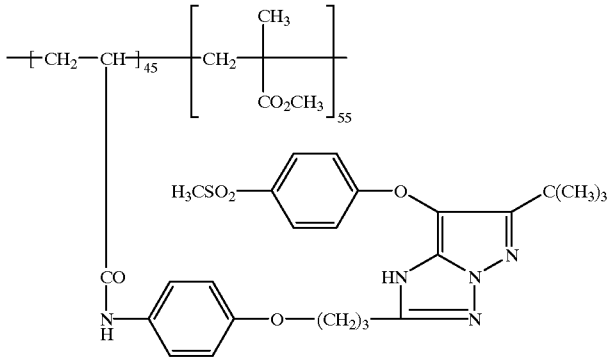
M-13
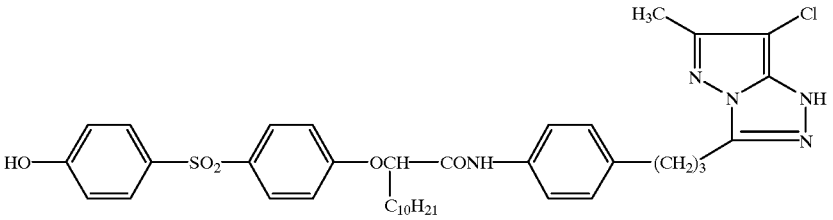
M-14
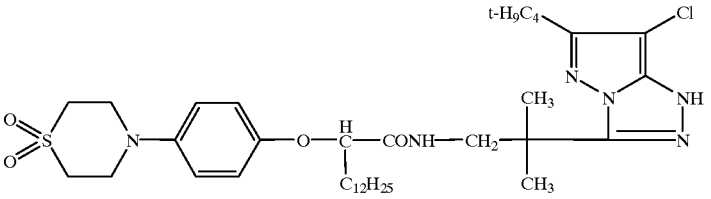
M-15
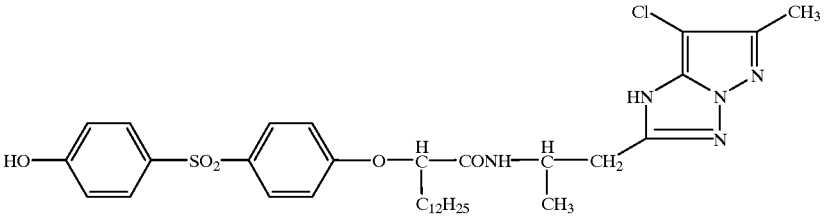
M-16
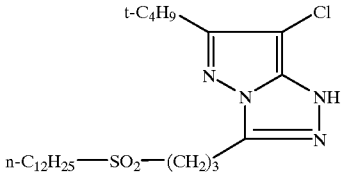

-continued

M-17

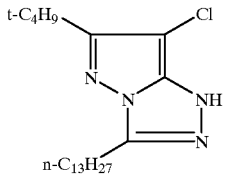

The pyrazolotriazole magenta couplers are conventionally used in a total quantity of 50 to 800 mg/m$^2$, in particular of 100 to 400 mg/m$^2$.

Examples of colour photographic materials are colour negative films, colour reversal films, colour positive films, colour photographic paper, colour reversal photographic paper, colour-sensitive materials for the dye diffusion transfer process or the silver dye bleaching process.

The photographic materials consist of a support onto which at least one photo-sensitive silver halide emulsion layer is applied. Thin films and sheets are in particular suitable as supports. A review of support materials and the auxiliary layers applied to the front and reverse sides of which is given in *Research Disclosure* 37254, part 1 (1995), page 285 and in *Research Disclosure* 38957, part XV (1996), page 627.

The material according to the invention preferably has a reflective support.

The colour photographic materials conventionally contain at least one red-sensitive, one green-sensitive and one blue-sensitive silver halide emulsion layer, optionally together with interlayers and protective layers.

Depending upon the type of the photographic material, these layers may be differently arranged. This is demonstrated for the most important products:

Colour photographic films such as colour negative films and colour reversal films have on the support, in the stated sequence, 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers. The layers of identical spectral sensitivity differ with regard to their photographic sensitivity, wherein the less sensitive partial layers are generally arranged closer to the support than the more highly sensitive partial layers.

Possible options for different layer arrangements and the effects thereof on photographic properties are described in *J. Inf. Rec. Mats.*, 1994, volume 22, pages 183–193.

Colour photographic paper, which is usually substantially less photosensitive than a colour photographic film, conventionally has on the support, in the stated sequence, one blue-sensitive, yellow-coupling silver halide emulsion layer, one green-sensitive, magenta-coupling silver halide emulsion layer and one red-sensitive, cyan-coupling silver halide emulsion layer.

The number and arrangement of the photosensitive layers may be varied in order to achieve specific results. For example, all high sensitivity layers may be grouped together in one package of layers and all low sensitivity layers may be grouped together another package of layers in order to increase sensitivity (DE-25 30 645).

The substantial constituents of the photographic emulsion layers are binder, silver halide grains and colour couplers.

Details of suitable binders may be found in *Research Disclosure* 37254, part 2 (1995), page 286.

Details of suitable silver halide emulsions, the production, ripening, stabilisation and spectral sensitisation thereof, including suitable spectral sensitisers, may be found in *Research Disclosure* 37254, part 3 (1995), page 286 and in *Research Disclosure* 37038, part XV (1995), page 89.

Photographic materials with camera sensitivity conventionally contain silver bromideiodide emulsions, which may optionally also contain small proportions of silver chloride. Photographic print materials contain either silver chloride-bromide emulsions with up to 80 wt. % of AgBr or silver chloride-bromide emulsions with above 95 mol. % of AgCl.

Details relating to colour couplers may be found in *Research Disclosure* 37254, part 4 (1995), page 288 and in *Research Disclosure* 37038, part II (1995), page 80. The maximum absorption of the dyes formed from the couplers and the developer oxidation product is preferably within the following ranges: yellow coupler 430 to 460 nm, magenta coupler 540 to 560 nm, cyan coupler 630 to 700 nm.

In order to improve sensitivity, grain, sharpness and colour separation in colour photographic films, compounds are frequently used which, on reaction with the developer oxidation product, release photographically active compounds, for example DIR couplers which eliminate a development inhibitor.

Details relating to such compounds, in particular couplers, may be found in *Research Disclosure* 37254, part 5 (1995), page 290 and in *Research Disclosure* 37038, part XIV (1995), page 86.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present in the layers as fine droplets (0.05 to 0.8 mm in diameter).

Suitable high-boiling organic solvents, methods for the introduction thereof into the layers of a photographic material and further methods for introducing chemical compounds into photographic layers may be found in *Research Disclosure* 37254, part 6 (1995), page 292.

The non-photosensitive interlayers generally located between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in *Research Disclosure* 37254, part 7 (1995), page 292 and in *Research Disclosure* 37038, part III (1995), page 84.

The photographic material may also contain UV light absorbing compounds, optical brighteners, spacers, filter dyes, formalin scavengers, light stabilisers, anti-oxidants, $D_{min}$ dyes, additives to improve stabilisation of dyes, couplers and whites and to reduce colour fogging, plasticisers (latices), biocides and others.

Suitable compounds may be found in *Research Disclosure* 37254, part 8 (1995), page 292 and in *Research Disclosure* 37038, parts IV, V, VI, VII, X, XI and XIII (1995), pages 84 et seq.

The layers of colour photographic materials are conventionally hardened, i.e. the binder used, preferably gelatine, is crosslinked by appropriate chemical methods.

Suitable hardener substances may be found in *Research Disclosure* 37254, part 9 (1995), page 294 and in *Research Disclosure* 37038, part XII (1995), page 86.

Once exposed with an image, colour photographic materials are processed using, different processes depending upon their nature. Details relating to processing methods and the necessary chemicals are disclosed in *Research Disclosure* 37254, part 10 (1995), page 294 and in *Research Disclosure* 37038, parts XVI to XXIII (1995), pages 95 et seq. together with example materials.

EXAMPLE 1

A colour photographic recording material was produced by applying the following layers in the stated sequence onto a film base of paper coated on both sides with polyethylene. Quantities are stated per 1 $m^2$. The silver halide application rate is stated as the corresponding quantities of $AgNO_3$.

Layer Structure 1

Layer 1: (Substrate layer)
- 0.2 g of gelatine

Layer 2: (Blue-sensitive layer)
- Blue-sensitive silver halide emulsion (99.5 mol. % chloride, 0.5 mol. % bromide, average grain diameter 0.8 mm) prepared from
- 0.45 g of $AgNO_3$ with
- 1.18 g of gelatine
- 0.55 g yellow coupler Y-1
- 0.1 g of white coupler W-1
- 0.2 g of dye stabiliser ST-1
- 0.29 g of oil former OF-1
- 0.10 g of oil former OF-2

Layer 3: (Interlayer)
- 1.10 g of gelatine
- 0.14 g of compound SC-1
- 0.07 g of tricresyl phosphate (TCP)

Layer 4: (Green-sensitive layer)
- Green-sensitised silver halide emulsion (99.5 mol. % chloride, 0.5 mol. % bromide, average grain diameter 0.6 mm) prepared from
- 0.30 g of $AgNO_3$ with
- 1.08 g of gelatine
- 0.25 g of magenta coupler M-17
- 0.25 g of dye stabiliser ST-2
- 0.10 g of dye stabiliser ST-3
- 0.25 g of dibutyl adipate
- 0.25 g of isooctadecanol Layer 5: (Interlayer)
- 1.15 g of gelatine
- 0.2 g of UV absorber UV-1
- 0.2 g of UV absorber UV-2
- 0.2 g of oil former OF-3
- 0.14 g of compound SC-1
- 0.04 g of TCP Layer 6: (Red-sensitive layer)
- Red-sensitised silver halide emulsion (99.5 mol. % chloride, 0.5 mol. % bromide, average grain diameter 0.5 mm) prepared from
- 0.30 g of $AgNO_3$ with
- 0.75 g of gelatine
- 0.2 g of UV absorber UV-1
- 0.36 g of cyan coupler C-1
- 0.12 g of dye stabiliser ST-4
- 0.24 g of TCP Layer 7: (UV protective layer)
- 0.35 g of gelatine
- 0.15 g of UV absorber UV-3
- 0.15 g of oil former OF-4

Layer 8: (Protective layer)
- 0.9 g of gelatine
- 0.3 g of hardener H-1

The following compounds were used in the layer structure of Example 1:

Y-1

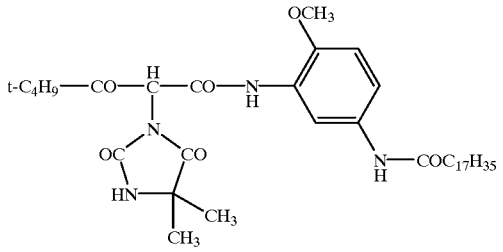

-continued
C-1
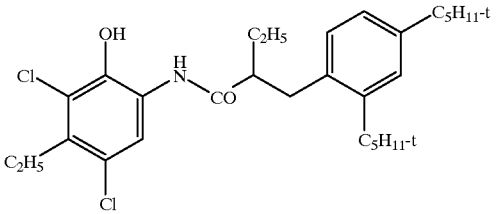
W-1
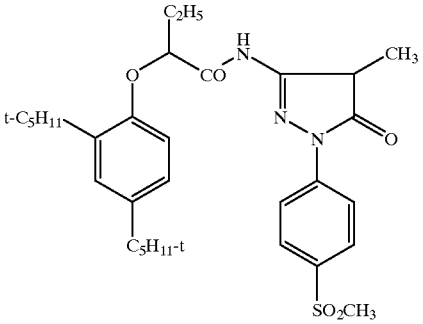
ST-1
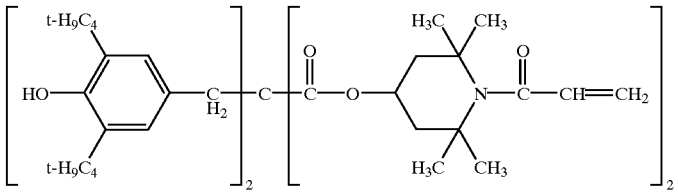
ST-2
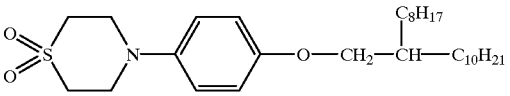
ST-3
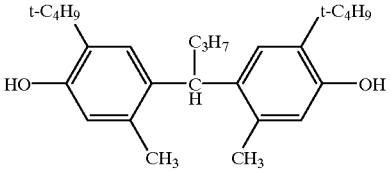
ST-4
1:2-mixture prepared from
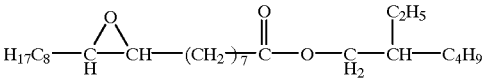
and
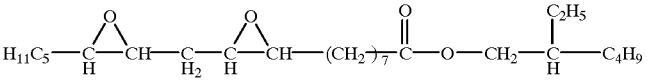
ST-5
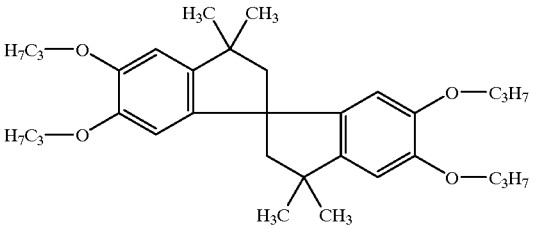
OF-1
Adipic acid polyester with 1,3-butanediol and 1,4-butanediol -continued
OF-2
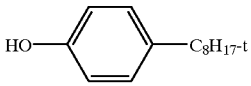
OF-3
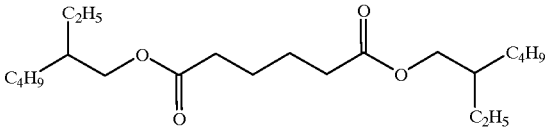
OF-4
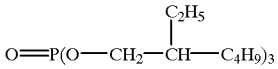
SC-1
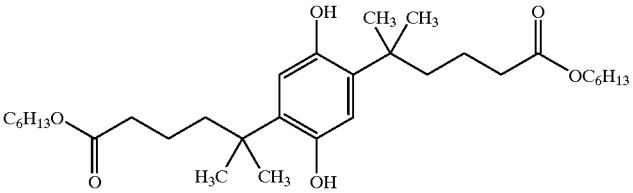
SC-2
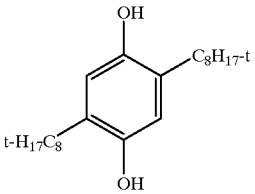
SC-3
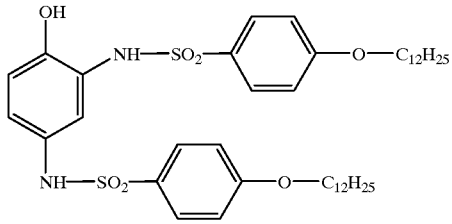
UV-1
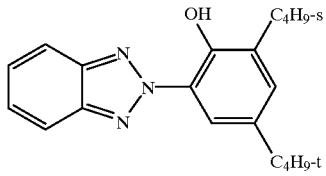
UV-2
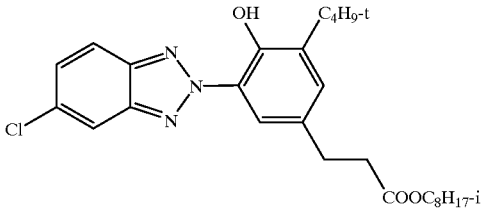
UV-3
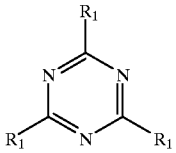

-continued

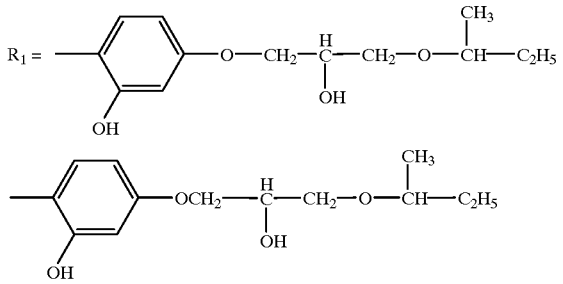

(1:1 - mixture)

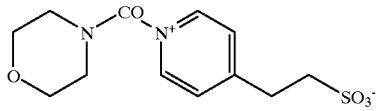

H-1

Layer Structures 2 to 11

In layer structures 2 to 11, compound SC-1 in layers 3 and 5 was replaced by the compounds stated in table 1. As for SC-1, the quantity was 0.14 g/m$^2$ in each case. Moreover, in structures 9 to 11, the magenta coupler M-17 in layer 4 was replaced by 0.18 g/m$^2$ of M-9 and the dye stabilisers ST-2 and ST-3 by 0.6 g/m$^2$ of ST-5.

The samples were exposed through a graduated grey wedge with green light and then processed as follows:

a) Colour developer—45 s—35° C.

| | |
|---|---|
| Tetraethylene glycol | 20.0 g |
| N,N-diethylhydroxylamine | 4.0 g |
| N-ethyl-N-(2-methanesulphonamidoethyl)-4-amino-3-methylbenzene sulphate | 5.0 g |
| Potassium sulphite | 0.2 g |
| Potassium carbonate | 30.0 g |

-continued

| | |
|---|---|
| Polymaleic anhydride | 2.5 g |
| Hydroxyethanediphosphonic acid | 0.2 g |
| Optical brightener (4,4'-diaminostilbene derivative) | 2.0 g |
| Potassium bromide | 0.02 g |

make up with water to 1000 ml; adjust pH value to pH=10.2 with KOH or $H_2SO_4$.

b) Bleach/fixing bath—45 s—35° C.

| | |
|---|---|
| Ammonium thiosulphate | 75.0 g |
| Sodium hydrogen sulphite | 13.5 g |
| Ethylenediaminetetraacetic acid (iron/ammonium salt) | 45.0 g |

make up with water to 1000 ml; adjust pH value to pH 6.0 with ammonia (25%) or acetic acid.

c) Rinsing—2 min—33° C.

d) Drying

Cyan density ($D_{cyan}$) at magenta density ($D_{magenta}$) 1.0 and magenta fog ($D_{min}$ (magenta)) were then measured (table 2). The samples were then exposed to the light from a daylight-standardised xenon lamp and irradiated with $15\times10^6\times h$. The percentage reduction in density $DD_{magenta}$ after irradiation was determined at initial density $D_{magenta}$= 1.0.

TABLE 2

| Layer structure | DOP scavenger in layers 3 and 5 | $D_{min}$ (magenta) | $D_{cyan}$ at $D_{magenta}$ = 1.0 | $DD_{magenta}$ in % | |
|---|---|---|---|---|---|
| 1 | SC-1 | 0.08 | 0.118 | −33 | Comparison |
| 2 | — | 0.09 | 0.152 | −26 | Comparison |
| 3 | SC-2 | 0.08 | 0.109 | −40 | Comparison |
| 4 | SC-3 | 0.08 | 0.123 | −28 | Comparison |
| 5 | P-1 | 0.08 | 0.102 | −22 | Invention |
| 6 | P-2 | 0.08 | 0.104 | −24 | Invention |
| 7 | P-3 | 0.08 | 1.108 | −24 | Invention |
| 8 | P-6 | 0.08 | 0.105 | −27 | Invention |
| 9 | SC-2 | 0.07 | 0.089 | −27 | Comparison |
| 10 | P-1 | 0.07 | 0.089 | −17 | Invention |
| 11 | P-7 | 0.07 | 0.087 | −15 | Invention |

As is evident, the samples according to the invention exhibit the greatest possible magenta dye stability and only very slight co-coupling of the red-sensitive layer.

EXAMPLE 2

A colour photographic recording material was produced by applying the following layers in the stated sequence onto a film base of paper coated on both sides with polyethylene. Quantities are stated per 1 m$^2$. The silver halide application rate is stated as the corresponding quantities of $AgNO_3$.

Layer Structure 12

Layer 1: As layer structure 1

Layer 2: (Blue-sensitive layer)

Blue-sensitive silver halide emulsion (99.5 mol. % chloride, 0.5 mol. % bromide, average grain diameter 0.8 mm) prepared from 0.45 g of $AgNO_3$ with 1.18 g of gelatine 0.55 g yellow coupler Y-2

0.1 g of white coupler W-1

0.2 g of dye stabiliser ST-1

0.29 g of oil former OF-5

0.10 g of oil former OF-2

Layer 3: As layer structure 1

Layer 4: (Green-sensitive layer)

Green-sensitised silver halide emulsion (99.5 mol. % chloride, 0.5 mol. % bromide, average grain diameter 0.6 mm) prepared from 0.30 g of $AgNO_3$ with 1.08 g of gelatine 0.20 g of magenta coupler M-16

0.20 g of dye stabiliser ST-2

0.10 g of dye stabiliser ST-6

0.50 g of diisooctyl phthalate

Layer 5: As layer structure 1

Layer 6: (Red-sensitive layer)

Red-sensitised silver halide emulsion (99.5 mol. % chloride, 0.5 mol. % bromide, average )rain diameter 0.5 mm) prepared from 0.30 g of $AgNO_3$ with 0.75 g of gelatine 0.2 g of UV absorber UV-1

0.36 g of cyan coupler C-2

0.12 g of dye stabiliser ST-4

0.24 g of TCP

Layer 7: (UV protective layer)

0.35 g of gelatine 0.15 g of UV absorber UV-4

0.15 g of oil former OF-4

Layer 8: As layer structure 1

The following new compounds were used in the layer structure of Example 2:

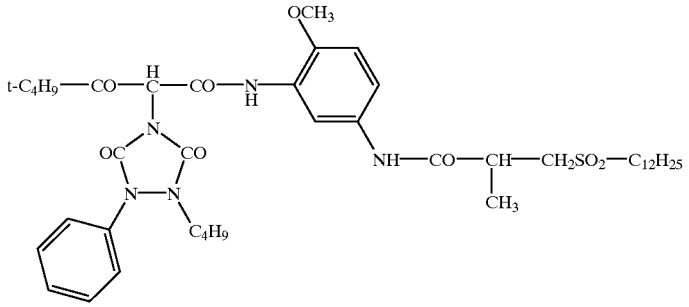

Y-2

OF-5 Adipic acid polyester with 1,3-butanediol and 1,6-hexanediol

C-2 1:1 mixture prepared from

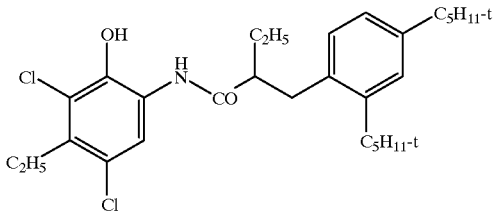

and

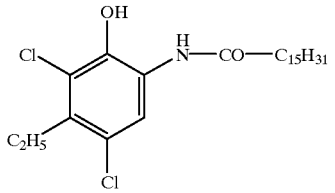

ST-6

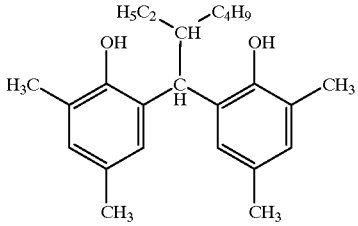

UV-4

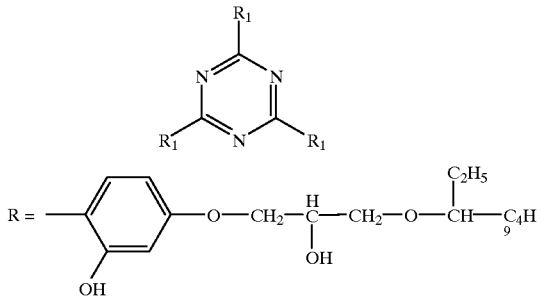

Layer Structures 13 to 22

In layer structures 13 to 22, compound SC-1 in layers 3 and 5 was replaced by the compounds stated in table 3 (structures 14, 15, 18, 19, 20: quantity in each case 0.14 g/m$^2$, structures 16, 17, 21, 22: quantity in each case 0.28 g/m$^2$). Moreover, in structures 20 to 22, the magenta coupler M-16 in layer 4 was replaced by 0.18 g/m$^2$ of M-9 and the dye stabilisers ST-2 and ST-6 by 0.6 g/m$^2$ of ST-5.

The samples were exposed through a graduated grey wedge with green light and then processed as in Example 1.

Cyan density ($D_{cyan}$) at magenta density ($D_{magenta}$) 1.0 and magenta fog ($D_{min}$ (magenta)) were then measured (table 3). The samples were then exposed to the light from a daylight-standardised xenon lamp and irradiated with $20\times10^6\times$h. The percentage reduction in density $DD_{magenta}$ after irradiation was determined at initial density $D_{magenta}$= 1.0.

TABLE 3

| Layer structure | DOP scavenger in layers 3 and 5 | $D_{min}$ (magenta) | $D_{cyan}$ at $D_{magenta}$ = 1.0 | $DD_{magenta}$ in % | |
|---|---|---|---|---|---|
| 12 | SC-1 | 0.08 | 0.121 | −40 | Comparison |
| 13 | — | 0.09 | 0.158 | −32 | Comparison |
| 14 | SC-2 | 0.08 | 0.112 | −47 | Comparison |
| 15 | SC-3 | 0.08 | 0.126 | −33 | Comparison |
| 16 | P-8 | 0.08 | 0.111 | −31 | Invention |
| 17 | P-9 | 0.07 | 0.110 | −33 | Invention |
| 18 | P-10 | 0.08 | 0.112 | −32 | Invention |
| 19 | P-11 | 0.08 | 0.111 | −32 | Invention |
| 20 | SC-2 | 0.07 | 0.091 | −32 | Comparison |
| 21 | P-12 | 0.07 | 0.089 | −22 | Invention |
| 22 | P-13 | 0.07 | 0.091 | −20 | Invention |

As evident, the samples according to the invention exhibit the greatest possible magenta dye stability and only very slight co-coupling of the red-sensitive layer.

What is claimed is:

1. A color photographic recording material which comprises on a support at least one blue-sensitive silver emulsion layer, which is associated with a yellow coupler, at least one green-sensitive silver halide emulsion layer, which is associated with a magenta coupler, and at least one red-sensitive silver halide emulsion layer, which is associated with a cyan coupler, together with non-photosensitive interlayers between the layers of differing color sensitivity, said at least one green-sensitive silver halide layer contains a 2-equivalent pyrazolone and/or a pyrazolotriazole coupler as the magenta coupler and at least one interlayer adjacent to this layer contains as a DOP scavenger a polyester comprising at least one dicarboxylic acid of the formula I (I)

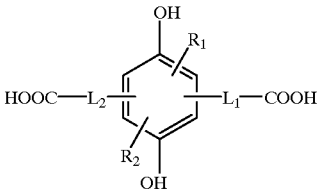

in which $L_1$ and $L_2$ are identical or different and are optionally substituted, divalent organic residues and $R_1$ and $R_2$ are identical or different and are hydrogen, alkyl, aralkyl, alkoxy, aryloxy or halogen and at least one polyhydroxy compound.

2. The color photographic recording material according to claim 1, wherein $L_1$ and $L_2$ are identical or different and are linear or branched alkylene residues having 1 to 8 carbon atoms and $R_1$ and $R_2$ are hydrogen.

3. The color photographic recording material according to claim 1, wherein the pyrazolotriazole coupler is of the formula II (II)

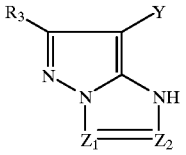

in which $R_3$ is hydrogen, halogen, alkyl, aryl, a heterocyclic group, cyano, alkoxy, acyloxy, carbamoyloxy, acylamino or a polymer reside, Y is hydrogen or a group eliminable under chromogenic development conditions, one of the residues $Z_1$ and $Z_2$ is a nitrogen atom and the other —$CR_4$— and $R_4$ has the same meaning as $R_3$, wherein one of the residues $R_3$ and $R_4$ is a ballast group or is substituted by a ballast group, wherein the ballast group may also be a polymer residue.

4. The color photographic recording material according to claim 1, wherein the DOP scavenger is used in the photographic material in a quantity of 5 to 150 mg/m$^2$ per interlayer.

5. The color photographic recording material according to claim 1, wherein the pyrazolotriazole coupler is used in the photographic material in a quantity of 50 to 800 mg/m$^2$.

6. The color photographic recording material according to claim 1, which further comprises a dicarboxylic acid selected from the group consisting of oxalic acid, malonic acid, succinic acid, glutaric acid, adipic acid, pimelic acid, suberic acid, azalaic acid, sebacic acid, n-undecanoic acid, n-dodecanoic acid, n-tridecanoic acid, n-tetradecanoic acid, n-pentadecanoic acid, n-hexadecanoic acid, maleic acid, fumaric acid, itaconic acid, phthalic acid, isophthalic acid and terephthalic acid.

7. The color photographic recording material according to claim 1, wherein the dicarboxylic acid of the formula I is selected from the group consisting of

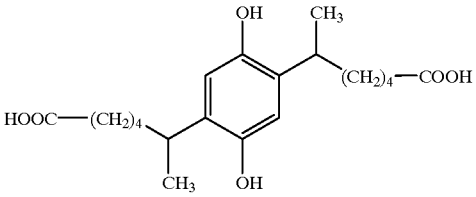

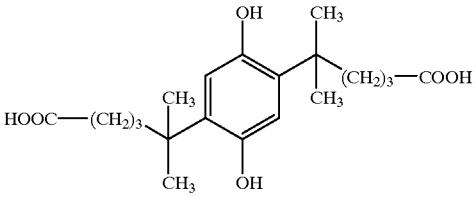

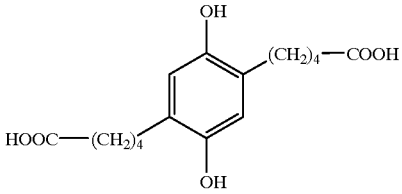

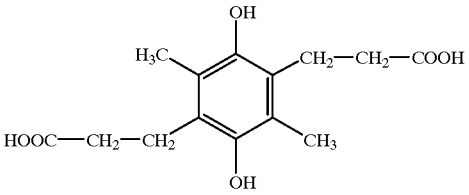

-continued and

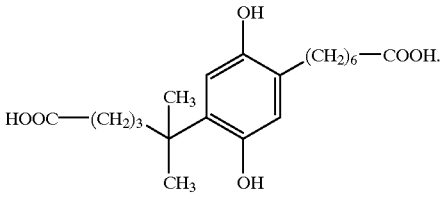

8. The color photographic recording material according to claim 2, wherein the DOP scavenger is used in the photographic material in a quantity of 10 to 80 mg/m$^2$ per interlayer.

9. The color photographic recording material according to claim 3, wherein Y is hydrogen, chlorine, S-alkyl, S-aryl or

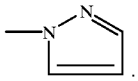

10. The color photographic recording material according to claim 3, wherein $R_3$ and $R_4$ together have at least 15 carbon atoms.

11. The color photographic recording material according to claim 3, wherein the pyrazolotriazole coupler is used in the photographic material in a quantity of 100 to 400 mg/m$^2$.

12. The color photographic recording material according to claim 1, wherein said support is a reflective support.

* * * * *